United States Patent [19]

Cadle

[11] 4,272,126

[45] Jun. 9, 1981

[54] JOGGLING BOARD FOR USE AS EXERCISE DEVICE OR AS ITEM OF LAWN FURNITURE

[75] Inventor: Walter L. Cadle, Tucker, Ga.

[73] Assignee: Rose Marie Cadle, Tucker, Ga.

[21] Appl. No.: 83,172

[22] Filed: Oct. 9, 1979

Related U.S. Application Data

[63] Continuation-in-part of Ser. No. 929,113, Jul. 27, 1978, abandoned.

[51] Int. Cl.[3] ..... A47C 3/029

[52] U.S. Cl. ..... 297/258; 272/56; 272/144

[58] Field of Search ..... 272/62, 109, 111, 113, 272/93, 134, 144, 146, 56, 96, 97, 33, 70, 85, 1 R, 1 P; 297/258

[56] References Cited

U.S. PATENT DOCUMENTS

| | | | |
|---|---|---|---|
| 1,507,944 | 9/1924 | Williams | 272/85 |
| 2,417,618 | 3/1947 | Scott | 272/56 |
| 3,618,940 | 11/1971 | Manocherian | 272/56 |
| 3,806,118 | 4/1974 | Way | 272/111 X |
| 3,961,787 | 6/1976 | Studebaker et al. | 272/93 |
| 4,183,521 | 1/1980 | Kroeker | 272/111 X |

*Primary Examiner*—William R. Browne
*Attorney, Agent, or Firm*—Harvey B. Jacobson

[57] ABSTRACT

An item of lawn furniture or exercise device is disclosed for exercise and amusement of one or more persons sitting or standing upon a horizontal board suspended from two support assemblies for cooperative movement of the ends of the board. The board is movable both longitudinally and transversely through use of a pair of support assemblies having rockers forming a substantially spheroidal rocking surface. In one structural form, a pair of crossed rocker arms form each support assembly, while in another form, a dished support plate is used in each support assembly. The item can be constructed of wood components, or alternatively, welded metal construction can be used for durability.

23 Claims, 12 Drawing Figures

JOGGLING BOARD FOR USE AS EXERCISE DEVICE OR AS ITEM OF LAWN FURNITURE

CROSS-REFERENCE TO RELATED APPLICATION

This application is a continuation-in-part of my copending application Ser. No. 929,113, filed July 27, 1978 and now abandoned.

BACKGROUND OF THE INVENTION

1. Field of the Invention

The invention relates to an article of lawn furniture for exercise and amusement of one or more persons. More particularly, the invention provides an elongated horizontal board or plank, supported near each end by support assemblies which cooperate to permit longitudinal and transverse motion of the plank when in use by one or more persons mounted on the board.

2. Description of the Prior Art

Devices known as joggling boards or joggling benches for longitudinal rocking motion, coupled with limited upward and downward swinging motion, have been known for over 100 years, such as the item described in Popular Science, January, 1941, page 155. Such a device, however, does not permit extensive transverse motion.

Various configurations of rocking devices are known in the prior art. Coplin in U.S. Pat. No. 2,803,461, issued Aug. 20, 1957, shows an exercising apparatus having a wooden rocker member in the shape of perpendicularly intersecting semi-circular boards. No rocker stops are shown, however, to limit the degree of tipping of the device, nor are the wings of the wooden rocker members braced in any way.

Studebaker et al, in U.S. Pat. No. 3,961,787, issued June 8, 1976, disclose curved rockers on a load supporting member, but fail to show a pair of support assemblies for permitting rotary or combined longitudinal and transverse motion of a board or a bouncing motion thereof. Shoger, in U.S. Pat. No. 4,018,438, issued Apr. 19, 1977, shows a horizontal board with supports at opposite ends, but motion of the board is not suggested or taught. Similarly, Slama, in Swiss Pat. No. 132,348, issued June 17, 1929, discloses a gymnastic apparatus with two double posts independent of each other, where a pair of frames is provided for a bar arranged for admission in the frame either slidingly vertically through a slot in the frame, or for placement on the horizontal top side of the frame, but motion of the board is not taught or suggested. Pitkanen, in Canadian Pat. No. 887,255, issued November 30, 1971, discloses a rockable balance plank which includes a plurality of longitudinally spaced and transversely extending rocker members which oscillatably support the plank for oscillatory motion in one plane only, namely in a plane perpendicular to the beam. No longitudinal motion is possible, nor is a bouncing or rotary motion possible with the Pitkanen device.

U.S. Pat. No. 1,283,210, issued Oct. 29, 1918, to Kinney, as well as U.S. Pat. No. 4,025,107, issued May 24, 1977, to Chippa, show rockable chairs for amusement or for exercise. A support ring having a central pivot point is present in the Kinney device to induce vibration in the body of the user, relying upon projections to contact the mounting surface or floor to furnish such vibrations. A fixed mounting is required by the Kinney device, leading to lack of portability and requiring a suitable mounting surface. Specifically, use as an item of lawn furniture cannot be contemplated by the Kinney device. The Chippa chair provides a relatively complex fully dished head for rotary or rocking motion of an associated chair having height adjustment and hingeably attached seating legs. Such a spoon-type bottom construction requires complex fabrication, and is directed to a collapsible chair for compactness of storage.

Rocker devices are shown in U.S. Pat. No. 2,923,345, issued Feb. 2, 1960, to Strauss, and in U.S. Pat. No. 2,930,430, issued Mar. 29, 1960, to Bloom. The Strauss patent countenances six rocker fins as a means to approximate rotary motion. Such rotary motion as results from the Strauss device lacks a smooth and vibration-free motion, since the tipped device generates an irregular or bouncing movement as rotation proceeds over the fin members, thereby detracting from the smoothness of a hemispherical or spheroidal motion.

In addition to the drawbacks, shortcomings, and deficiencies of the rocker devices taught by the prior art patents above, all such devices fail to teach a cooperative relationship between two or more rocker assemblies to produce an exercise device or item of furniture comprising a longitudinally elongated board or plank supported by two or more such assemblies.

SUMMARY OF THE INVENTION

Accordingly, it is an object of the present invention to provide an exercise device or item of outdoor or lawn furniture for use by one or more persons who sit or stand upon an elongated board or plank supported by a pair of support assemblies, each of which has a central vertical axis and rocker means to provide smooth, substantially spheroidal combined longitudinal and transverse motion of the board.

Another object of the invention is to provide the support assemblies with dead stops and stabilizer rings to prevent tipping of the device and promote its safe use.

Still another object of the invention is to furnish a lower header and longitudinal spacing member for reducing radial and longitudinal disorientation between support assemblies.

Yet another object of the invention is to provide an item of outdoor or lawn furniture constructed from common materials and simple woodworking tools.

A further object of the invention is to provide a device for use by one or more persons who sit or stand upon any elongated plank or board supported by a pair of dished support plates upon which the plank or board is supported.

Another further object is to provide an item of outdoor lawn furniture constructable from durable matrials, such as welded metal components.

Yet a further object of the invention is to provide a device useful for exercising the body or for the amusement of one of more users.

In accomplishing these and further objects, a pair of rocker assemblies is constructed from intersecting hemispherical sections and joined by a circumferential stabilizer ring, to provide a smooth rocking action in any direction. Each rocker assembly incorporates two vertical risers with an upper header and a lower header, the upper header providing support for a longitudinally extending bench or board, and the lower header providing the mounting means for a longitudinal spacing member. Optionally, the bench can be supplied with a backrest made from vertical stanchions and holding longitudinally extending supports.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
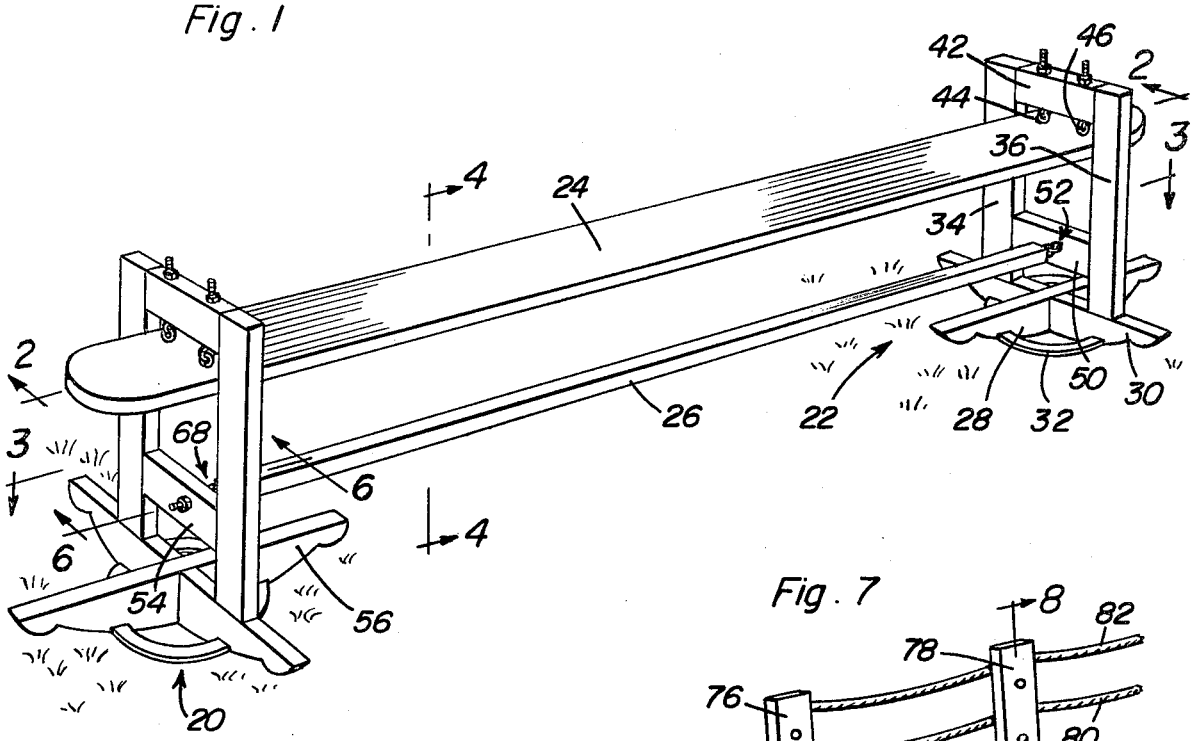
FIG. 1 is a perspective view of the first form of exercise device or item of furniture constituting the present invention.
Figure 5:
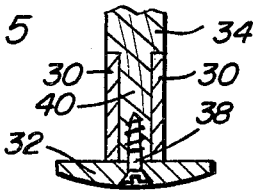
FIG. 5 is a fragmentary enlarged sectional view taken substantially upon a plane passing along section line 5—5 on FIG. 4, showing details of attachment of the circumferential stabilizer ring, rocker arm and upright support.

FIG. 1 shows the joggling board generally to be made up of two support assemblies designated by the numerals 20 and 22, along with board or plank 24 and lower spacing member 26. Since the device is symmetrical, the description of components of support assembly 22 will apply to the corresponding components of support assembly 20. Support assembly 22 constitutes intersecting rocker arms 28 and 30, in association with circumferential stabilizer ring 32. Upright support members or risers 34 and 36 are attached to rocker arm 30 by tenon joints shown in FIG. 5, with wood screw 38 holding stabilizer ring 32 to tongue 40 of upright support member 34. Stabilizer ring 32, besides performing a reinforcing and supporting function for rocker arms 30 and 28 also assures a smooth and spheriodal rocking action of the support assembly when the device is in use. Although a smooth circular path of support assembly 22 results during purely longitudinal motion, and likewise results during purely transverse motion, due to direct contact of rocker arms 28 or 30 with the ground, motion of support assembly 22 in any other direction relies upon circumferential stabilizer ring 32 for insuring the smoothness of a rocking surface, which approximates spheroidal motion. Accordingly processing motion of the axis of support assembly 22, or motion approximating the surface of a cone, has been found to be considerably smoother and more accurate than such rotary motion when a circumferential stabilizer ring is not present.

Upper header 42, joining the upper ends of upright support members 34 and 36, serves as the anchor point for flexible joints 44 and 46 which provide support near end 48 of board 24. Ends 48 of board 24 are rounded for reasons of safety and decorative appearance. Lower header 50 is supported by upright support members 34 and 36, and constitutes the mount for lower spacing member 26, through flexible joint 52. Preferably, upper header 42 and lower header 50 are joined by mortise and tenon joints to upright support members 34 and 36, although other means of attachment can also be support members 34 and 36, although other means of attachment can also be successfully used. Flexible joints 44, 46 and 52 can be of any suitable type which permits angular flexing while maintaining a secure attachment under both tension and sideways displacement.

It is important that lower header 50, along with the corresponding lower header 54 on support assembly 20, be supported between the upright support members on support assembly 22 and support assembly 20 so that lower spacing member 26 does not interfere with rocker arms 28 and 56 during longitudinal rocket movement. The arrangement of supports and flexible joints 44, 46 and 52 makes up a structural triangle, forming with the corresponding supports on support assembly 20 a triangular prism having a structural rigidity which dictates that support assemblies 20 and 22 move in unison with each other. Accordingly, radial and longitudinal disorientation between support assemblies 20 and 22 is eliminated, obviating uncontrollable and undesirable twisting motions which would otherwise result during use of the device.

Figure 4:
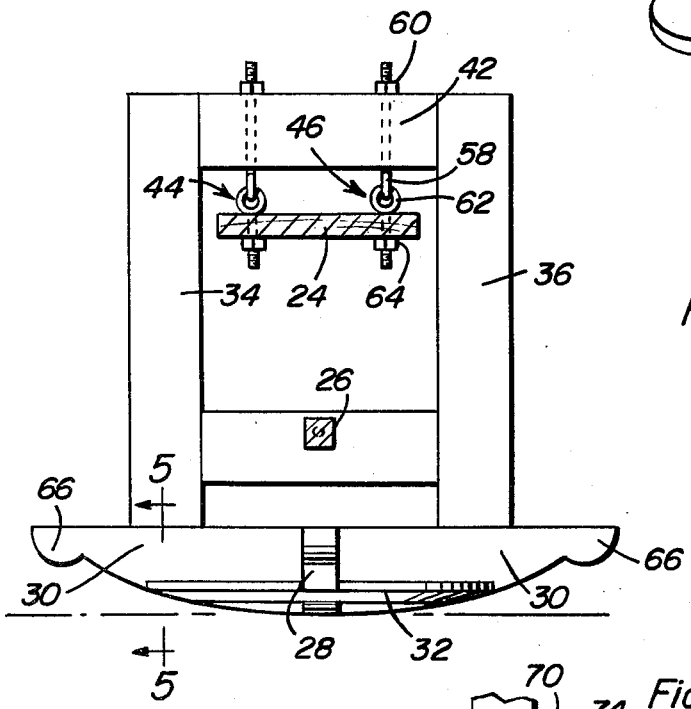
FIG. 4 is a transverse sectional view taken substantially upon a plane passing along section line 4—4 on FIG. 1.

FIG. 4 shows details of flexible joints 44 and 46 on board 24, each of which is made up of two interlocking eyebolts. Joint 46, for instance, comprises upper eyebolt 58, passing through a hole bored in upper header 42 and held in place by nut 60. Lower eyebolt 62 passes through a hole bored in board 24, and held in place by nut 64. For reasons of safety, an appropriate cap can be placed over upwardly projecting nut 60, or, alternatively, a suitable recess countersunk in upper header 42 can be used to eliminate upward projections from upper header 42. Rocker arm 30, as well as all other rocker arms, has nodules or stops 66 near each outer extremity, in order to prevent tipping or upsetting during vigorous use of the device.

Figure 6:
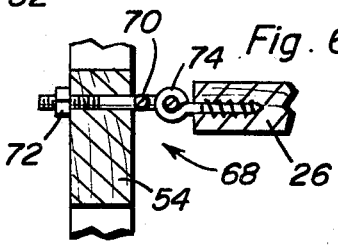
FIG. 6 is a fragmentary sectional view taken substantially upon a plane passing along section line 6—6 on FIG. 1, showing details of association of the lower header and spacing member.
Figure 2:
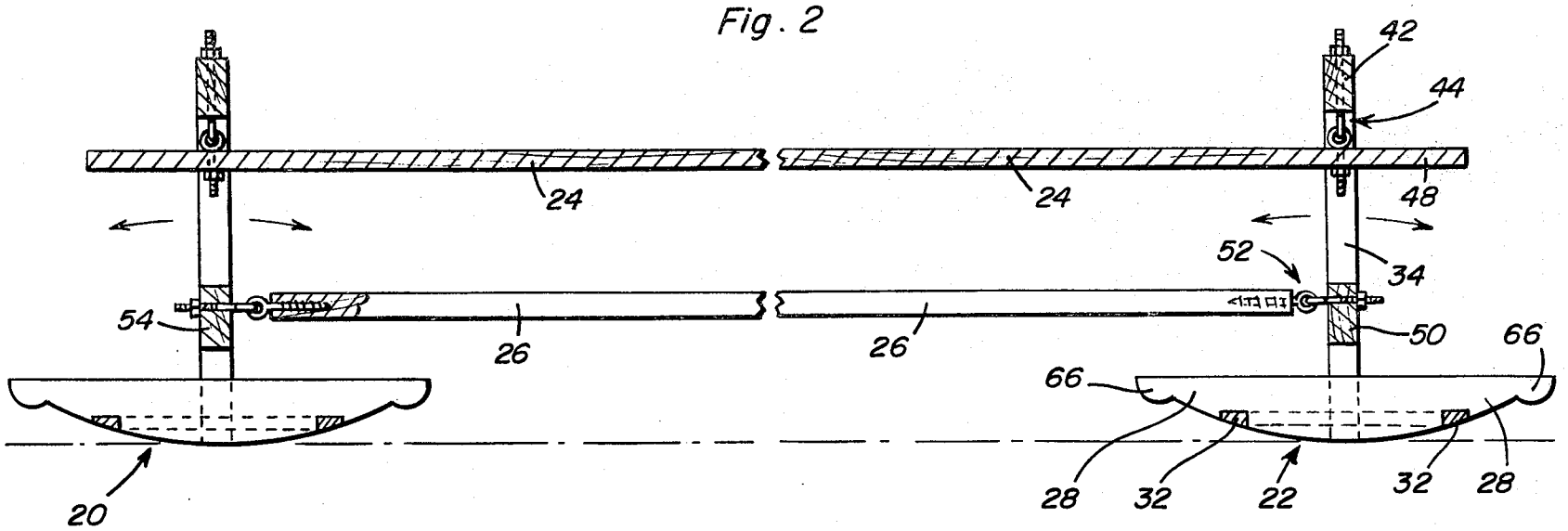
FIG. 2 is a longitudinal sectional view of the device taken substantially upon a plane passing along section line 2—2 on FIG. 1.
Figure 3:
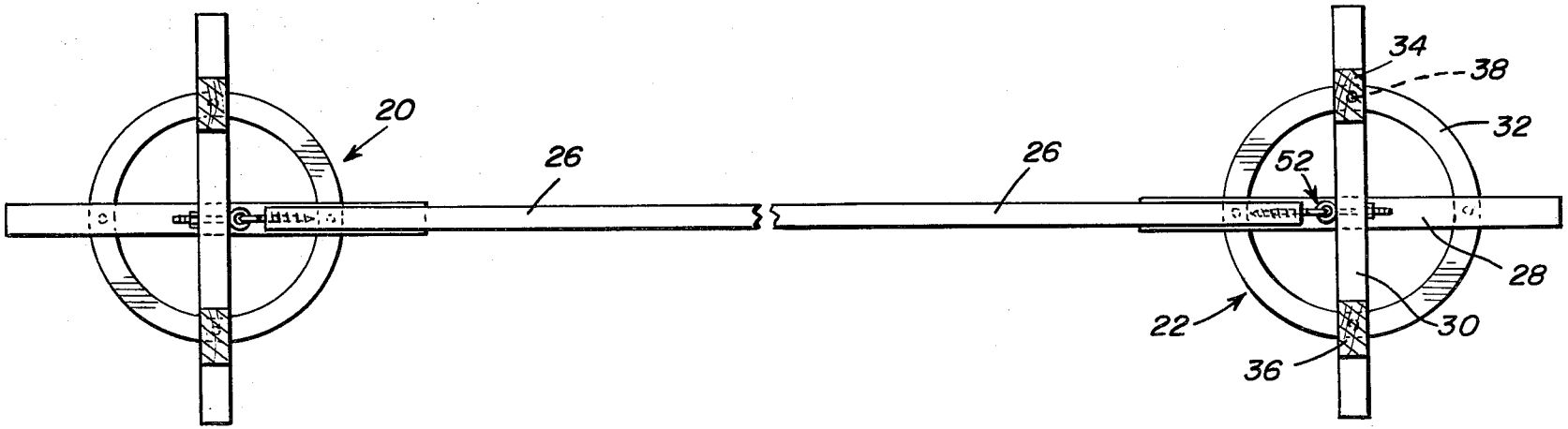
FIG. 3 is a top sectional view, taen substantially upon a plane passing along section line 3—3 on FIG. 1.

Details of flexible joint 68 between lower header 54 on support assembly 20 and lower spacing member 26 are shown in FIG. 6. Two interlocking eyebolts are shown, with eyebolt 70 passing through lower header 54 and held in place by nut 72. Eyebolt 74, however, is equipped with wood screw threads, and is so inserted in spacing member 26.

Figure 7:
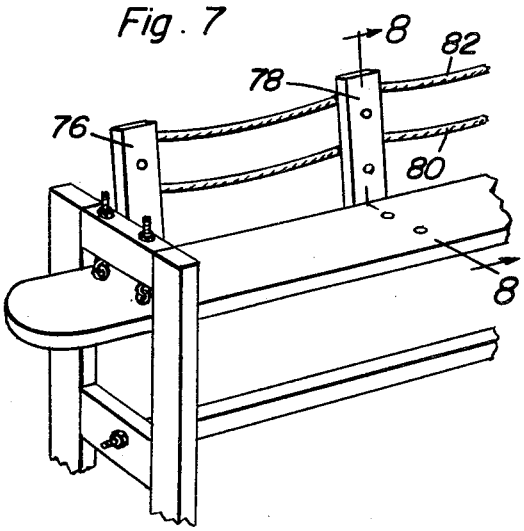
FIG. 7 is a fragmentary perspective view of a second embodiment of the first form of the invention, showing an associated backrest comprising vertical stanchions holding lengths of cord.

The device as illustrated in FIG. 1 can be used by a person sitting astride board 24 and facing in the longitudinal direction, or by a person facing the transverse direction with both legs on the same side of board 24. When used in the latter configuration as a bench for sitting and resting, a backrest can be conveniently employed, such as is shown in FIG. 7. Vertical stanchions 76 and 78 are shown supporting ropes or cords 80 and 82, upon which the user's back can rest. Metal bracker 84, shown in FIG. 8, supports vertical stanchion 78, with bar 86 providing support for cord 82, and bar 88 providing support for cord 80. Appropriate wood screws and bolts secure the entire assembly to stanchion 78, and bolts 90 have countersunk heads in board 24 to secure the lower extension of bracket 84 to board 24. An alternative arrangement for stanchion 78' is shown in FIG. 9, where lag screw 92 holds stanchion 78' near its base to board 24', and cords 80' and 82' pass through holes bored in stanchion 78'.

In operation, the user sits or stands on board 24 of the device, and starts board 24 in motion. As the user bounces or joggles briskly, the user begins to leave board 24 each time it rises. As the user shifts his weight, board 24 begins a swinging motion on support assemblies 20 and 22, allowing the user's body to follow a complex course in three dimensions.

Figure 10:
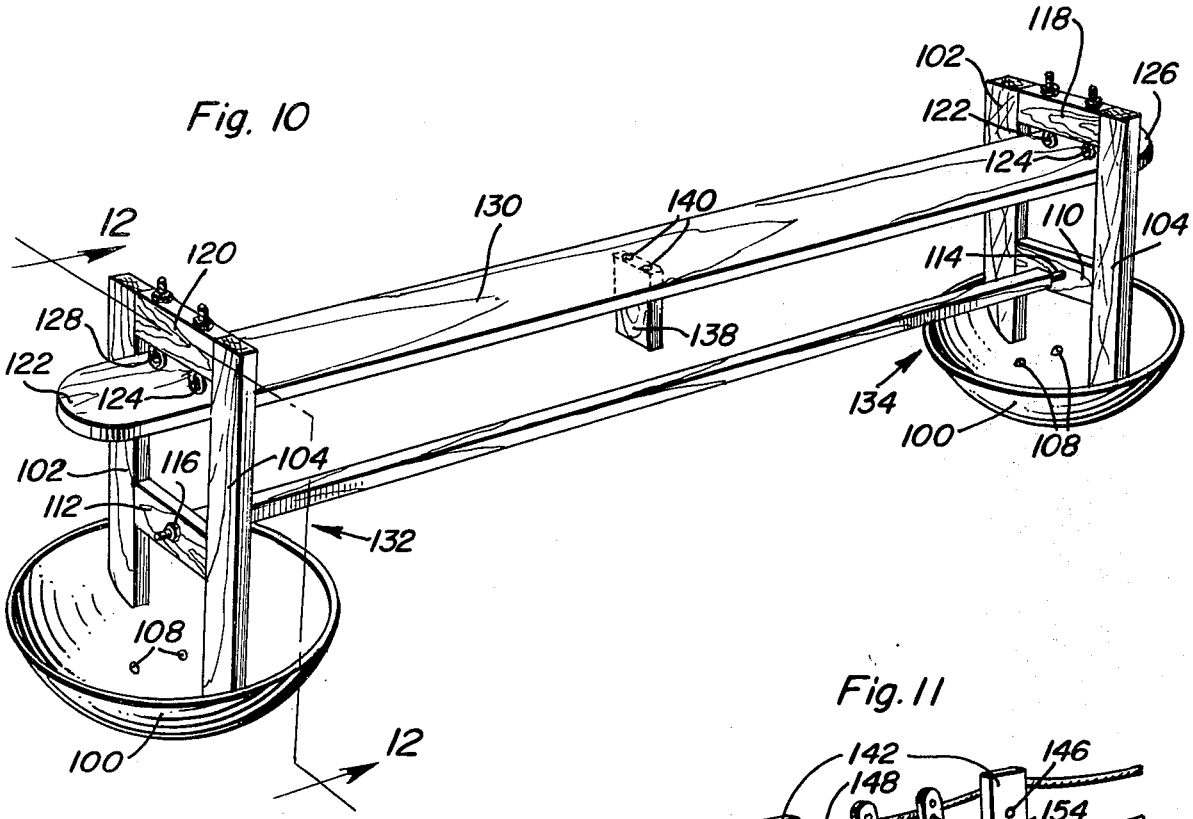
FIG. 10 is a perspective view of a second form of exercise device or item of furniture constituting the present invention.

In the second form of the invention, shown in its first embodiment in FIG. 10, the support assemblies are modified from the support assemblies of the first form of the invention, in that dished plate 100 rests upon the lawn or other surface on which the device is to be used. Upright support members 102 and 104 are attached to plate 100 by wood screws 106 although when upright support members 102 and 104 are made of metal other forms of fastening, such as welding or tapping for insertion of a machine bolt, can be used instead. Dished support plate 100 is provided with perforations of holes 108 to allow drainage of water when the device is used outdoors.

Upright support members 102 and 104 are joined by lower headers 110 and 112, between which lower spacing member 114 is bolted at flexible joints 114 and 116, which can be of any suitable type which permits angular flexing while maintaining a secure attachment under both tension and sideways displacement. Upper headers 118 and 120 join upright support members 102 and 104 near their upper extremity, and upper headers 118 and 120 further serve as the anchor points for flexible joints 122 and 124 which provide support near ends 126 and 128 of board 130. Details of joints 114, 122 and 124 are preferably the same as the analogous joints 52, 46 and 44, which have been heretofore described in detail in connection with the first form of the invention, particularly at FIGS. 4 and 6. In the form of the invention shown in FIG. 10, it is important that lower header 110, as well as lower header 112, be supported between upright support members 102 and 104 at each respective end of lower spacing member 114 so that lower spacing member 114 does not interfere with dished support plate 100 during longitudinal rocking movement of dished plates 100. The arrangement of supports and flexible joints makes up a structural triangle, forming a triangular prism having a structural rigidity which indicates that support assemblies 132 and 134 move in unison together. Accordingly, radial and longitudinal disorientation between support assemblies 132 and 134 is substantially eliminated, obviating uncontrollable and undesirable twisting motions which could otherwise result.

Keel 138 shown in connection with the second form of the invention serves to prevent breakage of board 130 under conditions of hard use. Should board 130 become overloaded with an excessive number of users, its downward movement will be limited as keel 138 strikes lower spacing member 114. When board 130 is constructed of wood, keel 138 is preferably attached to board 130 by wood screws 140, although other equivalent fastening means can also be used.

Figure 8:
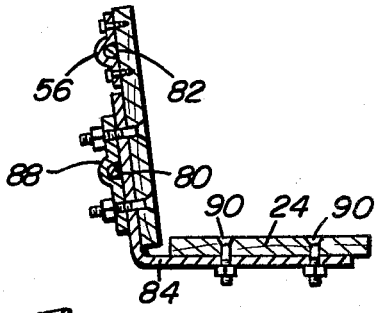
FIG. 8 is a transverse sectional view of a stanchion taken sustantially upon a plane passing along section line 8—8 on FIG. 7.
Figure 9:
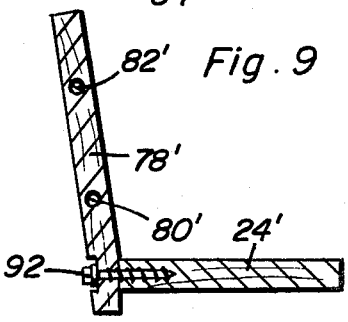
FIG. 9 is a transverse sectional view of a stanchion in an alternative arrangement to that of FIG. 8.
Figure 11:
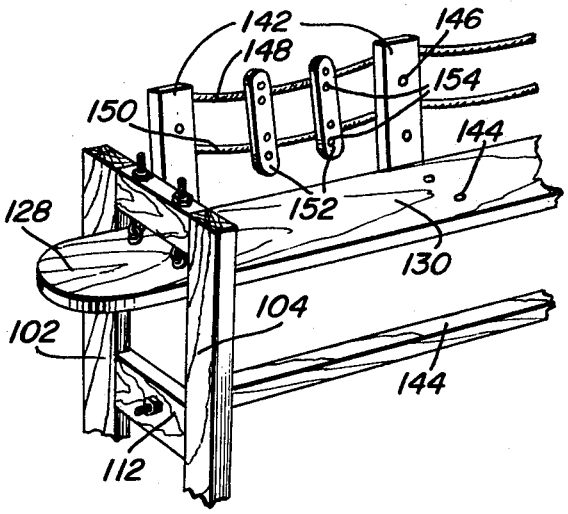
FIG. 11 is a fragmentary perspective view of a second embodiment of the second form of the invention, showing an associated backrest comprising vertical stanchions holding lengths of cord.

In the second embodiment of the second form of the invention shown in FIG. 11, a plurality of vertical stanchions 142 are mounted on board 130, preferably in the same manner shown and described for the second embodiment of the first form of the invention, as illustrated in FIG. 8. Accordingly, stanchions 142 are bolted to a metal bracket (not shown) by bolts 146, and the metal bracket is bolted to board 130 by bolts 144. The metal brackets receive cords 148 and 150, and cords 148 and 150 additionally support battens 152, which serve to hold boards 148 and 150 in a more disciplined relationship and offer additional support for any user of the device leaning against battens 152. Preferably, battens 152 are attached to cords 148 and 150 by brackets (not shown), which are bolted by bolts 154 to battens 152.

Substitution of dished plate 100 for intersecting rocker arms 28 and 30 of the first form of the invention facilitates and enhances rotary motion of the device, and particularly facilitates diagonal rocking in an oblique direction from the longitudinal direction.

Figure 12:
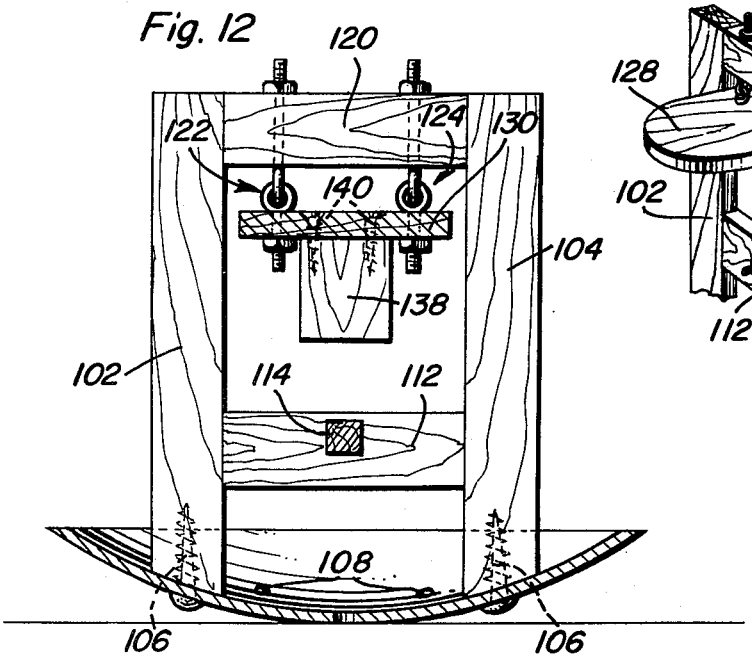
FIG. 12 is a transverse sectional view of the first embodiment of the second form, taken substantially upon a plane passing along section line 12—12 on FIG. 10.

Although vertical support members 102 and 104 are illustrated in FIGS. 10, 11 and 12 as being made of wood, it may be desirable to utilize other materials of construction than wood, such as welded metal, in order to improve the durability of the device.

The device illustrated in FIGS. 10 and 12 can be used by a person sitting astride board 130 and facing in a longitudinal direction, or by a person facing in a transverse direction with both legs on the same side of board 130. When used in the latter configuration as a bench for sitting and resting, the backrest arrangement of FIG. 11 can be conveniently employed. In operation, the user sits or stands on board 130 of the device and starts board 130 in motion. As the user bounces or joggles briskly, the user begins to leave board 130 each time it rises, and as the user shifts his weight, board 130 begins a swinging motion on support assemblies 132 and 134, allowing the user's body to follow a complex course in three dimensions. As with the first form of the invention, a wide variety of games can be played with the device, and two or more persons can use the device at the same time. The device is useful for exercise as well as amusement, and is suitable as an item of lawn furniture for outdoor use. It is to be noted that holes 108 permit drainage of rain water when device 130 is allowed to remain in an outdoor environment.

Competitive, as well as non-competitive, games can be played with the device, and two or more persons can use the device at the same time. Children, as well as adults, can benefit from use of the device, and if the device is to be used only by children, board 24 can be somewhat less sturdy than if the device is for use by adults as well. The device is useful for exercise as well as amusement, since a wide variety of motions possible with the device provide opportunity for exercising a large number of muscle groups of the body.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An exercise device or lawn furniture device comprising a horizontal longitudinally extending board for supporting one or more persons, a pair of spaced apart support assemblies having mounting means flexibly holding each end of said board to permit combined longitudinal and transverse motion of the board with respect to the support assemblies caused by a person's movements on said board, and an elongated lower spacing member mounted at each end to said support assemblies beneath and parallel to said board, each of said support assemblies having rocker means directly contacting a floor or the earth for permitting combined rocking movements in longitudinal and transverse directions of said support assemblies device, said assemblies moving in unison with each other.

2. The device of claim 1 wherein said rocker means comprises a pair of perpendicularly intersecting rigidly mounted rocker arms.

3. The device of claim 2 wherein said rocker arms terminate in a downwardly projecting stop during said longitudinal and transverse rocking of said assemblies, whereby the degree of tipping of the device can be limited.

4. The device of claim 3 together with a circumferential annular stabilizer ring mounted on the lower surfaces of said rocker arms to present a rocking surface approximating a spheroidal shape during rotary motion of said support assemblies.

5. The device of claim 4 wherein said flexible mounting means comprises for each support assembly holding an end of said board at least two flexible joints mounted to each said support assembly and dependingly holding an end of said board.

6. The device of claim 5 wherein each of said flexible joints comprises a pair of interlocking eyebolts, each pair of interlocking eyebolts including an upper eyebolt connected to said support assembly and a lower eyebolt connected to an end of said board.

7. The device of claim 6 wherein each said support assembly comprises a pair of upright support members fastened to a rocker arm oriented perpendicular to the longitudinal direction of the device, together with an upper header mounted between the support members near their upper extremities for support of said upper eyebolts.

8. The device of claim 7 wherein each said upright support member has mounted therebetween a lower header to which said lower spacing member is flexibly attached, said lower header being positioned on said upright support member to prevent interference beteen said rocker arms and said lower spacing member.

9. The device of claim 8 wherein said board has a length, thickness, and composition which allows rhythmical vertical motion by said person or persons during use.

10. The device of claim 9 together with a backrest attached to a longitudinal edge of said board.

11. The device of claim 10 wherein said backrest comprises a plurality of vertical stanchions in spaced relation along said board and a plurality of cords extending longitudinally between and supported by said stanchions.

12. The device of claim 11 wherein each of said stanchions is mounted near its base by a lag screw to said board, and each of said cords passes through holes in said stanchions.

13. The device of claim 11 wherein each of said stanchions is connected to said board by angular brackets, and means securing the cords along the rear surface of the stanchions.

14. The device of claim 1 wherein said rocker means includes a pair of rocker arms perpendicular to each other, each arm having an arcuate bottom surface, and a ring mounted on said bottom surfaces and bridging the space between the arms.

15. The device of claim 1 wherein each of said rocker means includes a spheroidal dished support plate for permitting combined rocking in the longitudinal or transverse directions or diagonal rocking of said support assemblies in unison.

16. The device of claim 15 wherein said dished support plates are provided with through holes for drainage of rain water collectable by said dished support plates.

17. The device of claim 16 wherein said flexible mounting means comprises for each support assembly holding an end of said board at least two flexible joints mounted to each said support assembly and dependingly holding an end of said board.

18. The device of claim 17 where each of said flexible joints comprises a pair of interlocking eyebolts, each pair of interlocking eyebolts including an upper eyebolt connected to said support assembly and a lower eyebolt connected to an end of said board.

19. The device of claim 18 wherein each said upright support member has mounted therebetween a lower header to which said lower spacing member is flexibly attached, said lower headed being positioned on said upright support member to prevent interference between said dished support plate and said lower spacing member.

20. The device of claim 19 wherein said board has a length, thickness, and composition which allows rhythmical vertical motion by said person or persons during use.

21. The device of claim 20 together with a backrest attached to a longitudinal edge of said board.

22. The device of claim 21 wherein said backrest comprises a plurality of vertical stanchions in spaced relation along said board, a plurality of cords extending longitudinally between and supported by said stanchions, and a plurality of vertical battens attached to said cords.

23. The device of claim 15 wherein said board is provided with a vertically depending keel for limiting the downward flexing thereof, whereby said keel maintains a minimum spacing between said board and said lower spacing member by contact of the keel with the lower spacing member.

* * * * *